US006666057B1

(12) United States Patent
Huang

(10) Patent No.: US 6,666,057 B1
(45) Date of Patent: Dec. 23, 2003

(54) LOCK WITH A FIXABLE KEY

(76) Inventor: Chiu-Mei Huang, 1Fl., No. 107, Chien-Kuo Road, Jen-Te Li, Hsueh-Chia Chen, Tainan Hsien (TW)

( * ) Notice: Subject to any disclaimer, the term of this patent is extended or adjusted under 35 U.S.C. 154(b) by 0 days.

(21) Appl. No.: 10/347,327

(22) Filed: Jan. 21, 2003

(51) Int. Cl.[7] ..... E05B 9/04; E05B 19/08

(52) U.S. Cl. ..... 70/375; 70/389; 70/397; 70/399; 70/408; 70/409; 70/429

(58) Field of Search ..... 70/395–397, 399, 70/401, 408, 409, 431, 375, 389, 390, 429, 430, 453, 454

(56) References Cited

U.S. PATENT DOCUMENTS

| | | | | | |
|---|---|---|---|---|---|
| 5,086,632 | A | * | 2/1992 | Hsu | 70/375 |
| 5,131,247 | A | * | 7/1992 | Hsu | 70/358 |
| 5,475,997 | A | * | 12/1995 | Chung | 70/375 |
| 5,671,623 | A | * | 9/1997 | Hsu | 70/375 |
| 6,378,345 | B1 | * | 4/2002 | Lin | 70/409 |
| 6,389,856 | B1 | * | 5/2002 | Watanuki et al. | 70/186 |

FOREIGN PATENT DOCUMENTS

| | | | | |
|---|---|---|---|---|
| CH | 371012 | * | 9/1963 | 70/429 |
| DE | 2505981 | * | 8/1976 | 70/429 |

* cited by examiner

*Primary Examiner*—Lloyd A. Gall

(57) ABSTRACT

A lock with a fixable key includes a shell, an upper half core, a lower half core, an elastic member and a fixable key. The upper and the lower half core contained in the shell respectively have a lengthwise passageway for a flexible moving member of the key to extend in to unlock the lock. The lower half core has a key hole in a rear end, and a groove for containing the elastic member having an upper end to fit in a notch formed in the groove. The key has the moving member, a push block and a housing having a position recess to engage the upper end of the elastic member so as to position the key in unlocking and make the moving member smoothly slide in the passageway of the lock to prevent the key from deadlocked or breaking in handling in unlocking or locking.

1 Claim, 2 Drawing Sheets

LOCK WITH A FIXABLE KEY

BACKGROUND OF THE INVENTION

1. Field of the Invention

This invention relates to a lock with a fixable key, particularly to one provided with a lower half core, which has a groove added with a notch for containing an elastic member with an upper end engaging the notch and a position recess provided in a housing of a fixable key for the upper end of the elastic member to engage in case of the key inserted in the key hole in front of the core passageway (i.e. the key hole) so as to let the key smoothly slide in the key hole of the lock to unlock.

2. Description of the Prior Art

A bending-type fixable key is generally used for a lock having a corrugated key hole (i.e. a core passageway). Such a fixable key commonly has a flexible moving member, a housing for containing the moving member, and a push block for pushing or retreating the moving member in locking and unlocking by pushing up beads provided in the lock core. But conventional fixable keys are not easy to let its front end align with the key hole, and subsequently the key is quite often unable to be smoothly pushed into the core passageway (i.e. the key hole) to unlock the lock. Further, the front end of the key may be broken owing to excessive force to push the key or deadlocked in the core of the lock.

SUMMARY OF THE INVENTION

The invention has been devised to offer a lock with a fixable key, with the flexible key possible to be pushed in the key hole of the lock smoothly.

The feature of the invention is a lower half core provided with a groove added with a notch communicating with a core passageway (or a key hole), and an elastic member contained in the groove and having an upper end to engage the notch to position stably the key so as to permit the key smoothly slide in the core passageway to unlock the lock.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
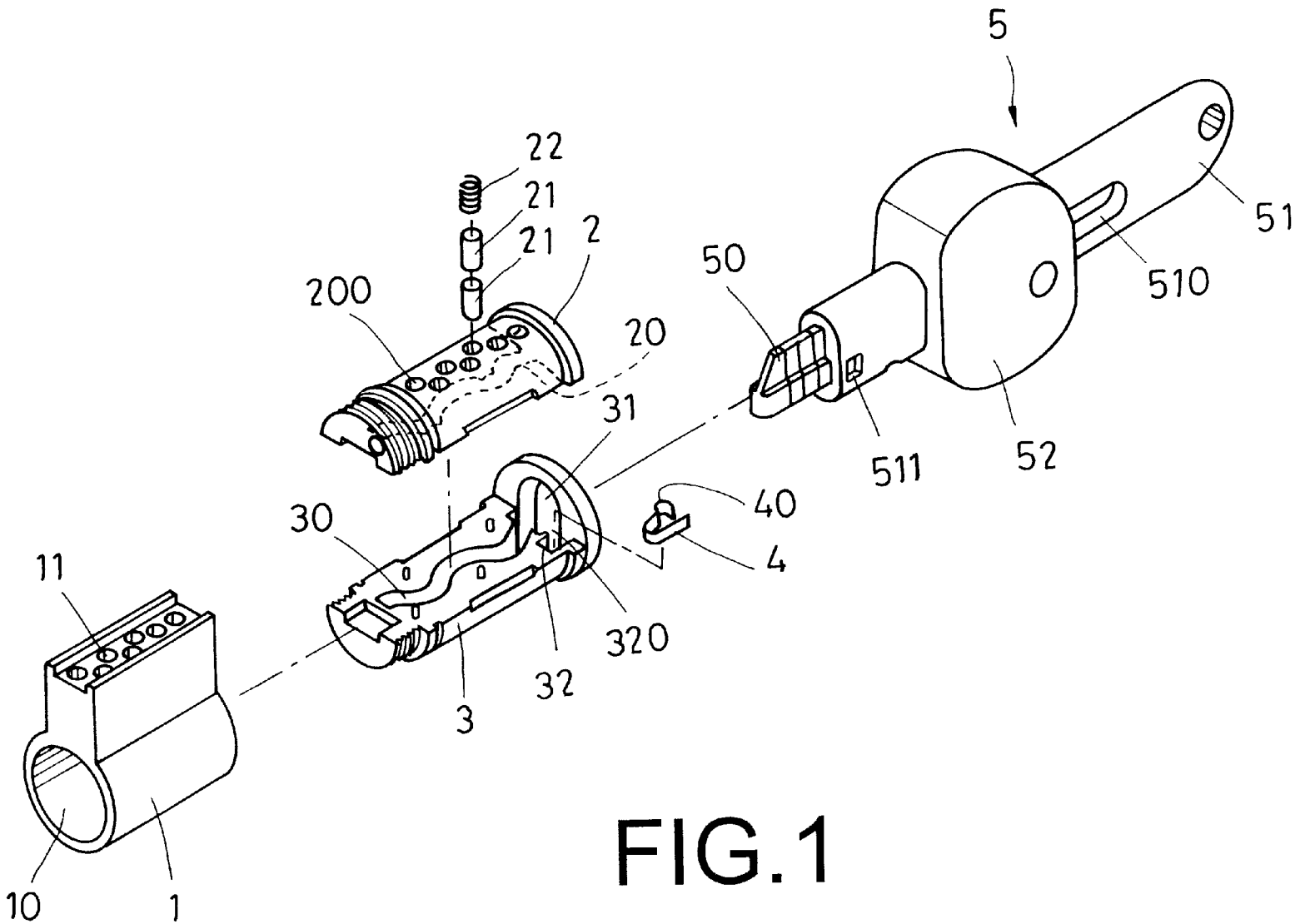
FIG. 1 is an exploded perspective view of a lock with a fixable key in the present invention; and, FIG. 2 is a cross-sectional view of the lock with a fixable key in the present invention, showing the lock being unlocked with a fixable key.

A preferred embodiment of a lock with a fixable key in the present invention as shown in FIG. 1, includes a shell 1, an upper half core 2, a lower half core 3, an elastic member 4, and a fixable key 5 as main components combined together.

The shell 1 has a chamber 10 extending lengthwise in a lower portion, and a plurality of bead holes 11 properly spaced apart in an upper portion and communicating with the chamber.

The upper half core 2 and the lower half core 3 are combined to form a whole core, which is contained in the chamber 10 of the shell 1, respectively having a half corrugated core passageway 20, 30 facing each other to form a complete corrugated core passageway. The upper half core 2 further has a plurality of vertical bead holes 200 properly spaced apart to respectively corresponding to the related bead holes 11 in the shell 1. Then a plurality of beads and springs are contained movably in the bead holes 200 and 11.

The lower half core 3 further has a key-inserting hole 31 formed at a rear end and defined by a nearly circular wall, and a groove 32 formed under the key-inserting hole 31, with a notch 320 added to the groove 32 communicating with the passageway 30.

The elastic member 4 is to be contained in the groove 32 of the lower half core 3, shaped nearly a U and having an upper end 40 able to fit in the notch 320.

The fixable key 5 has a flexible moving member 50, a housing 51 and a push block 52. The flexible moving member 50 is contained movable forward and backward in the housing 51, having its rear end pivotally connected with the push block 52, which can then push forward or pull backward the moving member 50 within sliding slots 510 of the housing 51. The housing 51 has a position recess 511 formed in a front sidewall near the front end to engage with the upper end 40 of the elastic member 40.

Figure 2:
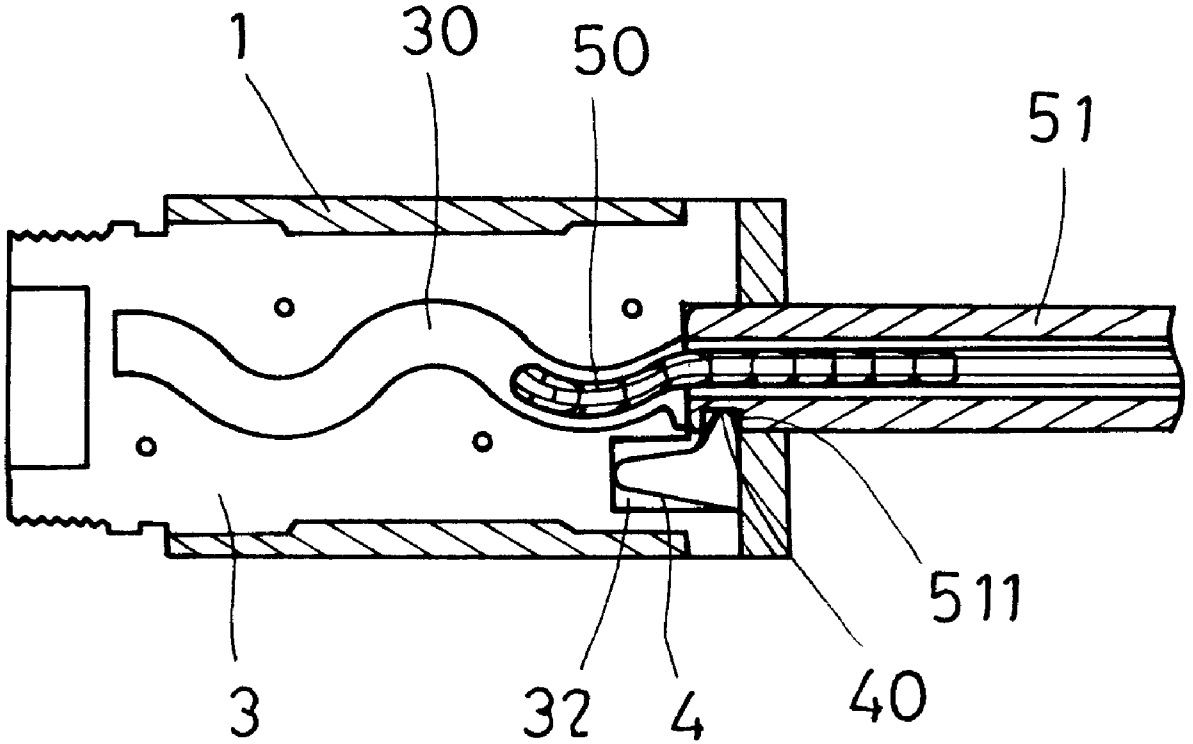

In using, referring to FIGS. 1 and 2, if the lock in a locked condition with the fixable key 5 pulled out of the lock is to be unlocked, the fixable key 5 is inserted in the key hole 31 of the lower half core 30 with the front end of the housing 51 headed forward, forcing the upper end 40 of the elastic member 4 engage the recess 511 of the housing 51. Then push block 52 is manually pushed forward to move together the moving member 50 forward at the same time in the housing 51 and also along the core passageways 20, 30. Then the beads 21 and the springs 22 in the upper half core 2 may all be pushed up to move into the beads holes 11 in the shell 1 so that the upper and the lower core 2 and 3 may be rotated to unlock the lock.

The lock with a fixable key in the present invention has the following advantages, as can be understood from the foresaid description.

1. The fixable key can be quickly inserted correctly in the keyhole (or the core passageway) of the lock and positioned stable to move the flexible moving member in the key (or the corrugated core passageway with ease to unlock the lock.

2. The flexible key can be quickly positioned correctly, enabling the moving member move smoothly in the core passageway, without possibility of breaking or deadlocking of the moving member.

While the preferred embodiment of the invention has been described above, it will be recognized and understood that various modifications may be made therein and the appended claims are intended to cover all such modifications that may fall within the spirit and scope of the invention.

What is claimed is:

1. A lock with a fixable key comprising:

a shell having a chamber in a lower portion, a plurality of bead holes properly spaced apart in an upper portion and communicating with said chamber;

an upper half core and a lower half core in a combined condition contained in said chamber of said shell, said upper and said lower half core respectively having a lengthwise corrugated half passageway facing each other to form a whole core passageway for a flexible moving member of a fixable key to extend therein, said upper half core having a plurality of vertical bead holes spaced apart to correspond to the bead holes of said shell, said bead holes respectively containing beads and a spring, said lower half core having a key hole formed in a rear end;

a fixable key having the flexible moving member, a housing and a push block combined together, said flexible moving member contained movably in said housing and having its rear end pivotally connected with said push block, said housing having a slide slot in two side walls defining an interior hollow;

characterized by a lower half core provided with a groove at a proper location, said groove having a notch added to communicating with said core passageway, an elastic member further provided and positioned in said groove and having an upper end fitting in said notch of said groove; said housing of said fixable key provided with a position recess to engage with said upper end of said elastic member; and, said fixable key having its front end inserted in said key hole of said lower core of said lock, said upper end of said elastic member then forced to engage with said position recess to stably position said fixable key so that the flexible moving member of the key may be pushed by said push block to smoothly move into said core passageway to unlock the lock.

* * * * *